US009381757B2

(12) United States Patent
Hori et al.

(10) Patent No.: US 9,381,757 B2
(45) Date of Patent: Jul. 5, 2016

(54) IMAGE RECORDING APPARATUS AND SHEET TRANSFER METHOD

(71) Applicant: SEIKO EPSON CORPORATION, Tokyo (JP)

(72) Inventors: Naoki Hori, Nagano (JP); Masashi Oba, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/636,236

(22) Filed: Mar. 3, 2015

(65) Prior Publication Data

US 2015/0251465 A1 Sep. 10, 2015

(30) Foreign Application Priority Data

Mar. 5, 2014 (JP) ..... 2014-042455

(51) Int. Cl.
*B41J 11/00* (2006.01)
*B41J 15/16* (2006.01)
(Continued)

(52) U.S. Cl.
CPC ..... *B41J 15/16* (2013.01); *B41J 11/002* (2013.01); *B65H 18/08* (2013.01); *B65H 18/103* (2013.01); *B65H 23/038* (2013.01); *B65H 23/0326* (2013.01); *B65H 23/0328* (2013.01); *B65H 23/044* (2013.01); *B65H 23/1806* (2013.01); *B65H 23/1888* (2013.01); *B65H 23/192* (2013.01); *B65H 2301/517* (2013.01); *B65H 2403/942* (2013.01); *B65H 2404/143* (2013.01); *B65H 2513/11* (2013.01); *B65H 2515/31* (2013.01); *B65H 2553/212* (2013.01); *B65H 2553/30* (2013.01); *B65H 2701/1315* (2013.01); *B65H 2801/15* (2013.01)

(58) Field of Classification Search
CPC ..... B41J 15/16; B41J 11/002; B65H 18/08; B65H 23/044; B65H 23/1806; B65H 2301/517; B65H 2403/942; B65H 2801/15
See application file for complete search history.

(56) References Cited

U.S. PATENT DOCUMENTS 6,331,056 B1 * 12/2001 Nohr ..... B41F 23/0409 347/101
2011/0062270 A1 3/2011 Yanagishita
2013/0135378 A1 5/2013 Tanjo et al.
2013/0141486 A1 6/2013 Suzuki

FOREIGN PATENT DOCUMENTS

JP 63-118281 A 5/1988
JP 01-192047 A 8/1989
(Continued)

OTHER PUBLICATIONS

The Extended European Search Report for the corresponding European Application No. 15157670.9 dated Jul. 13, 2015.

*Primary Examiner* — Thinh Nguyen
(74) *Attorney, Agent, or Firm* — Global IP Counselors, LLP

(57) ABSTRACT

A rotation shaft configured to rotate in a direction in which a sheet is fed in and in a direction in which the sheet is wound while supporting the sheet, a control unit configured to apply tension to the sheet by the rotation shaft by controlling torque applied to the rotation shaft, an ejection unit configured to eject light-curable liquid onto the sheet, and an irradiation device configured to irradiate light onto the liquid ejected onto the sheet by the ejection unit are provided. The tension applied to the sheet by the rotation shaft when the rotation shaft rotates in the direction in which the sheet is wounded is smaller than the tension applied to the sheet by the rotation shaft when the rotation shaft rotate in the direction in which the sheet is fed in.

9 Claims, 5 Drawing Sheets

(51) Int. Cl.

| | |
|---|---|
| ***B65H 18/08*** | (2006.01) |
| ***B65H 23/00*** | (2006.01) |
| ***B65H 23/18*** | (2006.01) |
| ***B65H 23/04*** | (2006.01) |
| ***B65H 23/032*** | (2006.01) |
| ***B65H 23/038*** | (2006.01) |
| ***B65H 23/188*** | (2006.01) |
| ***B65H 23/192*** | (2006.01) |
| ***B65H 18/10*** | (2006.01) |

(56) References Cited

FOREIGN PATENT DOCUMENTS

| | | | |
|---|---|---|---|
| JP | 04-094357 | A | 3/1992 |
| JP | 08-175723 | A | 7/1996 |
| JP | 2005-074773 | A | 3/2005 |
| JP | 2013-111780 | A | 6/2013 |
| JP | 2013-116788 | A | 6/2013 |

* cited by examiner

| | FORWARD TRANSFER | BACKWARD TRANSFER |
|---|---|---|
| Ta | 60(N) | 30(N) |
| Tb | 120(N) | 120(N) |
| Tc | 30(N) | 60(N) |

IMAGE RECORDING APPARATUS AND SHEET TRANSFER METHOD

CROSS-REFERENCE TO RELATED APPLICATIONS

This application claims priority to Japanese Patent Application No. 2014-042455 filed on Mar. 5, 2014. The entire disclosure of Japanese Patent Application No. 2014-042455 is hereby incorporated herein by reference.

BACKGROUND

1. Technical Field

The present invention relates to a technology that applies tension to a sheet being transferred.

2. Related Art

The printer in Japanese Laid-Open Patent Publication No. 2013-111780 is provided with a feeding shaft and a take-up shaft that support the respective end of a sheet, and transfers the sheet from the feeding shaft to the take-up shaft by rotating the feeding shaft and the take-up shaft. In addition, this printer ejects light-curable inks onto the sheet during the transfer from the feeding shaft to the take-up shaft, and irradiates light onto the inks. Thus, a sheet having an image formed from cured light-curable inks is wound onto the take-up shaft.

In addition to the forward transfer that transfers the sheet from the feeding shaft to the take-up shaft as described above, the printer is sometimes configured to conduct a backward transfer that transfers the sheet from the take-up shaft to the feeding shaft. In a printer capable of performing this type of backward transfer, the rotation shafts of the take-up shaft and the feeding shaft are required to have the function of feeding the sheet, and not only the function of winding the sheet. In this case, from the perspective of stable feeding of the sheet, adequate tension is appropriately applied to the sheet. Therefore, a configuration is considered in which a high tension is applied to the sheet from the rotation shafts.

However, this configuration is advantageous for feeding the sheet from a rotation shaft, but cannot be said to be advantageous for winding the sheet onto a rotation shaft. That is, an image formed by curing light-curable inks is thicker compared to, for example, an image formed from water-based inks. Therefore, because a high tension was applied to the sheet by the rotation shaft, the problem was that when the image formed on the sheet was wound at a high tension to the rotation shaft, unevenness caused by the thickness of the image developed in the wound sheet.

SUMMARY

In light of the above problems, an objective of the present invention is to provide a technology that is able to limit the production of unevenness in the sheet that was caused by the thickness of the image formed by curing light-curable liquids in an image recording apparatus that applies tension to the sheet by rotation shafts capable of winding up and feeding the sheet, and a sheet transfer method.

To achieve the objectives described above, an image recording apparatus related to one aspect of the invention is provided with a rotation shaft configured to rotate in a direction of feeding of a sheet and a direction of winding of the sheet while the sheet is supported, a control unit configured to control torque applied to the rotation shaft to apply tension to the sheet by the rotation shaft, an ejection unit configured to eject light-curable liquid onto the sheet, and an irradiation device configured to irradiate light onto the liquids ejected onto the sheet by the ejection unit. The tension that the rotation shaft applies to the sheet when the rotation shaft rotates in the direction of the winding of the sheet is smaller than the tension that the rotation shaft applies to the sheet when the rotation shaft rotates in the direction of the feeding of the sheet.

In order to achieve the objectives described above, an sheet transfer method related to another aspect of the invention is provided with applying tension to a sheet by a rotation shaft while feeding from the rotation shaft the sheet on which an image is formed by curing light-curable liquid by light irradiation, and applying tension to the sheet by the rotation shaft while winding the sheet onto the rotation shaft. The tension applied to the sheet while winding the sheet onto the rotation shaft is smaller than the tension applied to the sheet while feeding from the rotation shaft the sheet.

In the aspect invention having this configuration (image recording apparatus, sheet transfer method), the rotation shaft feeds in or winds up the sheet while applying tension to the sheet. In this case, the tension applied to the sheet when winding the sheet is smaller than the tension applied to the sheet when feeding the sheet. Consequently, the sheet can be stably fed because a relatively high tension is applied to the sheet from the rotation shaft when feeding in the sheet. On the other hand, because the tension applied to the sheet by the rotation shaft is relatively small when the sheet is being wound, the sheet can be prevented from being wound onto the rotation shaft at a high tension. As a result, even when an image having a relatively thick film formed on the sheet by curing the light-curable liquids is wound onto the rotation shaft, the unevenness caused by the thickness of the image can be prevented from developing in the sheet.

In this case, the image recording apparatus may be configured so that the tension applied to the sheet by the control unit when the rotation shaft is rotated in the direction of the feeding of the sheet is at least two times greater than the tension applied to the sheet by the control unit when the rotation shaft rotates in the direction of the winding of the sheet.

The image recording apparatus related to another embodiment of the invention is provided with a first rotation shaft supporting one end of the sheet, a second rotation shaft supporting the other end of the sheet, a control unit configured to apply tension to the sheet by the first rotation shaft and the second rotation shaft by controlling the first rotation shaft and the second rotation shaft, an ejection unit configured to eject light-curable liquid onto the sheet, and an irradiation unit configured to irradiate light onto the liquid ejected onto the sheet by the ejection unit. The first rotation shaft and the second rotation shaft are configured to rotate in a first direction, which is a direction in which the first rotation shaft feeds the sheet and a direction in which the second rotation shaft winds up the sheet; and in a second direction, which is a direction in which the second rotation shaft feeds the sheet and a direction in which the first rotation shaft winds up the sheet. The tension applied to the sheet by the first rotation shaft when the first rotation shaft rotates in the second direction is smaller than the tension applied to the sheet by the first rotation shaft when the first rotation shaft rotates in the first direction. The tension applied to the sheet by the second rotation shaft when the second rotation shaft rotates in the first direction is smaller than the tension applied to the sheet by the second rotation shaft when the second rotation shaft rotates in the second direction.

In this image recording apparatus, the sheet is transferred by a so-called roll-to-roll transfer by the first rotation shaft and the second rotation shaft that support different ends of the sheet. In particular, the first rotation shaft and the second rotation shaft can rotate in a first direction, which is the direction in which the first rotation shaft feeds the sheet and the direction in which the second rotation shaft winds up the sheet; and a second direction, which is the direction in which the second rotation shaft feeds the sheet and the direction in which the first rotation shaft winds up the sheet. Then, the tension applied to the sheet by the first rotation shaft when the first rotation shaft rotates in the second direction (direction for winding the sheet) is smaller than the tension applied to the sheet by the first rotation shaft when the first rotation shaft rotates in the first direction (direction for feeding the sheet). And, the tension applied to the sheet by the second rotation shaft when the second rotation shaft rotates in the first direction (direction for winding the sheet) is smaller than the tension applied to the sheet by the second rotation shaft when the second rotation shaft rotates in the second direction (direction for feeding the sheet). As a result, even when an image having a relatively thick film formed on the sheet by curing the light-curable liquids is wound by the first rotation shaft or the second rotation shaft, the unevenness that develops in the sheet due to the image thickness can be suppressed.

In addition, the image recording apparatus may be configured so that the control unit is configured to execute a first operation that transfers a sheet from the first rotation shaft to the second rotation shaft by rotating the first rotation shaft and the second rotation shaft in the first direction, and a second operation that transfers a sheet from the second rotation shaft to the first rotation shaft by rotating the first rotation shaft and the second rotation shaft in the second direction.

In this case, the image recording apparatus may be configured so that when the control unit executes the first operation, the tension applied to the sheet by the second rotation shaft is smaller than the tension applied to the sheet by the first rotation shaft; and when the control unit executes the second operation, the tension applied to the sheet by the first rotation shaft is smaller than the tension applied to the sheet by the second rotation shaft.

The image recording apparatus may be configured to provide a first drive roller configured to drive the sheet between the first rotation shaft and the second rotation shaft, and a second drive roller configured to drive the sheet between the first drive roller and the second rotation shaft. The ejection unit faces the sheet between the first drive roller and the second drive roller, the control unit is configured to control at least one of the first drive roller and the second drive roller, and control the tension of the sheet between the first drive roller and the second drive roller, and when either one of the first operation or the second operation is conducted, the tension applied to the sheet between the first drive roller and the second drive roller is greater than the tension applied to the sheet by the first rotation shaft and the tension applied to the sheet by the second rotation shaft.

In this kind of configuration in which the ejection unit faces the sheet, if the sheet shifts around during transfer due to the first operation or the second operation, the ejection unit and the sheet are assumed to sometimes come into contact. To handle this, in this image recording apparatus, the first drive roller and the second drive roller are provided, and the ejection unit faces the sheet between the first drive roller and the second drive roller. Then by controlling at least one of the drive rollers, the tension of the sheet is controlled in the part facing the ejection unit. In particular, when either the first operation or the second operation is executed, the tension applied to the sheet between the drive rollers is larger than the tension applied to the sheet by the rotation shafts. Namely, when either the first operation or the second operation is executed, because a high tension is applied to the sheet in the part opposite the ejection unit, shifting of the sheet during transfer is suppressed, and contact between the ejection unit and the sheet can be limited.

In addition, the image recording apparatus may be configured so that a steering unit configured to drive the first rotation shaft in an axial direction is provided; and the ejection unit is configured to eject the light-curable liquid onto the sheet transferred by the first operation. In this image recording apparatus, the light-curable liquids are ejected toward the sheet transferred by the first operation, namely the sheet transferred from the first rotation shaft to the second rotation shaft, to form the image. In particular, because the steering unit is provided to drive the first rotation shaft in the axial direction, the sheet can be fed to the ejection unit from the first rotation shaft while the steering unit adjusts the position of the sheet in the axial direction. Moreover, according to the present invention, because relatively high tension is applied to the sheet from the first rotation shaft when the sheet is fed, the position of the sheet can be effectively adjusted by the steering unit, and the sheet at an appropriately adjusted position in the axial direction can be fed from the first rotation shaft to the ejection unit.

In addition, the image recording apparatus may be configured so that the tension applied to the sheet by the first rotation shaft when the first rotation shaft rotates in the first direction is at least two times the tension applied to the sheet by the first rotation shaft when the first rotation shaft is rotated in the second direction.

To achieve the above objectives, an image recording apparatus related to another embodiment of the invention is provided with a rotation shaft configured to rotate in a first direction and in a second direction that is opposite to the first direction, a first drive roller and a second drive roller configured to drive the sheet, a control unit configured to apply tension to the sheet by the rotation shaft by controlling torque applied to the rotation shaft, an ejection unit configured to eject light-curable liquid onto the sheet, an irradiation device configured to irradiate light onto the liquid ejected on the sheet by the ejection unit, and a measurement unit configured to measure the tension of the sheet. In the first direction which is a direction in which the rotation shaft feeds the sheet, the rotation shaft, the first drive roller, the second drive roller, the ejection head, and the measurement unit are positioned in the order of the rotation shaft, the measurement unit, the first drive roller, the ejection head, and the second drive roller. Measurement values of the measurement unit when the rotation shafts rotate in the second direction are smaller than measurement values of the measurement unit when the rotation shafts rotate in the first direction.

In another embodiment of the invention, the sheet tension is controlled so that the measurement of the sheet tension when the rotation shafts rotate in the second direction (direction for winding the sheet) is smaller than the measurement of the sheet tension when the rotation shafts rotate in the first direction (direction for feeding the sheet). Thus, a relatively high tension is applied to the sheet from the rotation shafts when the sheet is fed, and the sheet can be stably fed. On the other hand, because a relatively small tension is applied to the sheet from the rotation shafts when the sheet is wound, the winding of the sheet onto the rotation shaft at a high tension can be prevented. As a result, even if an image with a relatively thick film formed on the sheet by curing the light-curable liquids is wound onto the rotation shaft, the unevenness that develops on the sheet due to the thickness of the image can be suppressed.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
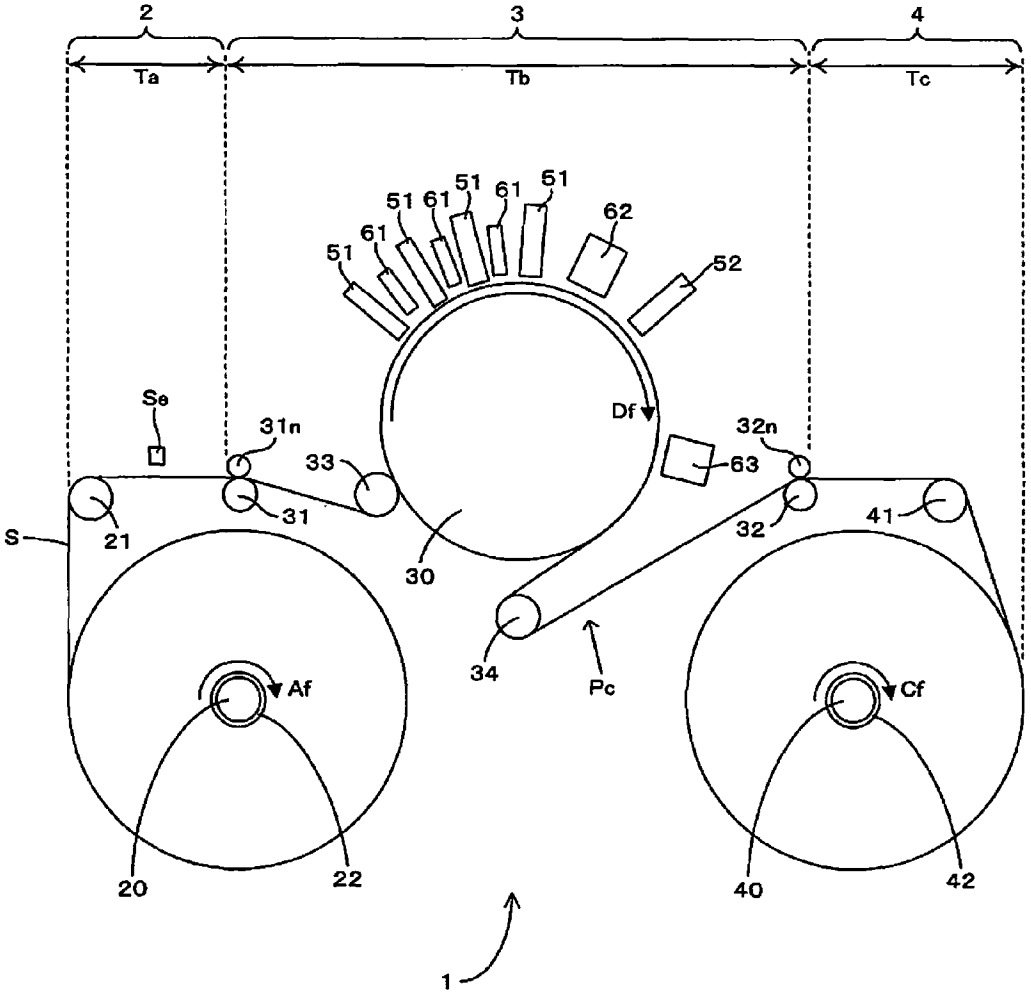
FIG. 1 is a diagram of the front view that shows an example the configuration of an apparatus that provides a printer capable of executing the present invention.

FIG. 1 is a diagram of the front view that schematically shows an example of the configuration of an apparatus that provides a printer capable of executing the present invention. As shown in FIG. 1, in the printer 1, one sheet S (web) wound in a roll form at both ends by a feeding shaft 20 and a take-up shaft 40 is threaded along the transfer path Pc. The sheet S records an image while being transferred in the transfer direction Df from the feeding shaft 20 to the take-up shaft 40. The types of sheet S are broadly classified as paper and film. As specific examples, the papers include high quality paper, cast coated paper, art paper, coated paper, and the like. The films include synthetic paper, polyethylene terephthalate (PET) film, polypropylene (PP) film, and the like. Generally, a printer 1 is provided with a feeding unit 2 that feeds a sheet S from the feeding shaft 20 (feeding region), a process unit 3 that records an image on the sheet S fed in from the feeding unit 2 (process region), and a take-up unit 4 that winds the sheet S recorded with an image in the process unit 3 onto the take-up shaft 40 (winding region). In the explanation below, one of the two sides of the sheet S is the side on which the image is recorded and is referred to as the front surface, and the other surface is referred to as the back surface.

The feeding unit 2 has a feeding shaft 20 that winds the end of the sheet S and a driven roller 21 that winds up the sheet S pulled out from the feeding shaft 20. The feeding shaft 20 winds up and supports the end of the sheet S when the front surface of the sheet S faces outward. By rotating the feeding shaft 20 in the direction of rotation Af (clockwise in FIG. 1), the sheet S wound on the feeding shaft 20 is fed to the process unit 3 through the driven roller 21. The sheet S is wound onto the feeding shaft 20 through the core tube 22 that can be installed on and removed from the feeding shaft 20. Thus, when the sheet S of the feeding shaft 20 is used up, a new core tube 22 wound with a rolled sheet S is installed on the feeding shaft 20, and the sheet S of the feeding shaft 20 can be replaced.

An edge sensor Se for detecting the edge of the sheet S from the driven roller 21 to the process unit 3 is provided in the feeding unit 2. For example, the edge sensor Se can be configured from a distance sensor, such as an ultrasound sensor. The position in the width direction (perpendicular direction to the plane on which FIG. 1 is represented) of the sheet S fed from the feeding unit 2 to the process unit 3 is adjusted by the steering unit 7 (FIG. 2) to be described later based on the detection results (detected values) of the edge sensor Se.

The process unit 3 appropriately conducts the processes via each of the functional units 51, 52, 61, 62, 63 arranged along the outer peripheral surface of a rotating drum 30 to record an image on the sheet S while the sheet S fed from the feeding unit 2 is supported by the rotating drum 30. In the process unit 3, a front drive roller 31 and a back drive roller 32 are provided on the two sides of the rotating drum 30. The sheet S transferred from the front drive roller 31 to the back drive roller 32 in the transfer direction Df is supported by the rotating drum 30 and recorded with an image.

The front drive roller 31 has a plurality of small projections formed by thermal spraying, and the sheet S fed in from the feeding unit 2 is in contact with the back surface side. By rotating in the clockwise direction in FIG. 1, the front drive roller 31 transfers the sheet S fed in from the feeding unit 2 to the downstream side in the transfer direction Df. A pinch roller 31*n* is provided opposite the front drive roller 31. The pinch roller 31*n* when pressed against the front drive roller 31 side is in contact with the front surface of the sheet S, and the sheet S is sandwiched by the front drive roller 31. By doing this, frictional force can be ensured between the front drive roller 31 and the sheet S, and the sheet S is reliably transferred by the front drive roller 31.

The rotating drum 30 is supported to enable rotation in both the transfer direction Df and the opposite direction by a support mechanism, which is omitted from the drawings, and is a cylindrical drum having, for example, a diameter of 400 (mm) and winds the sheet S from the back surface side that is being transferred from the front drive roller 31 to the back drive roller 32. This rotating drum 30 supports the sheet S on the back surface side while frictional force with the sheet S is received and follows the rotation of the sheet S. In process unit 3, driven rollers 33, 34 are provided to turn back the sheet S on both sides of a winding unit to the rotating drum 30. Of these, the driven roller 33 winds the front surface of the sheet S between the front drive roller 31 and the rotating drum 30. In addition, the driven roller 34 winds the front surface of the sheet S between the rotating drum 30 and the back drive roller 32 to turn back the sheet S. In this way, the winding unit of sheet S on the rotating drum 30 can ensure a longer length by turning back the sheet S on the upstream and downstream sides of the transfer direction Df with respect to the rotating drum 30.

The back drive roller 32 has a plurality of small projections formed by thermal spraying on the outer peripheral surface and winds the sheet S being transferred from the rotating drum 30 via the driven roller 34 from the back surface. Then by rotating in the clockwise direction in FIG. 1, the back drive roller 32 transfers the sheet S to the take-up unit 4 on the downstream side in the transfer direction Df. A pinch roller 32*n* is provided for the back drive roller 32. When pressed toward the back drive roller 32 side, the pinch roller 32*n* is in contact with the front surface of the sheet S, and the sheet S is sandwiched by the back drive roller 32. Thus, frictional force is ensured between the back drive roller 32 and the sheet S, and the sheet S can be reliably transferred by the back drive roller 32.

Thus, the sheet S transferred from the front drive roller 31 to the back drive roller 32 is supported on the outer peripheral surface of the rotating drum 30. A plurality of recording heads 51 corresponding to mutually different colors are provided in the process unit 3 in order to record a color image on the front surface of the sheet S supported by the rotating drum 30. Specifically, four recording heads 51 corresponding to yellow, cyan, magenta, and black are aligned in the transfer direction Df in this order of colors. Each of the recording heads 51 is opposite the front surface of the sheet S in contact with the rotating drum 30 with a small clearance space and ejects the corresponding ink color (colored ink) from a nozzle by an ink ejection method. Then, each recording head 51 ejects ink toward the sheet S being transferred in the transfer direction Df to form a color image on the front surface of the sheet S.

Ultraviolet (UV) inks (light-curable inks) that are cured by irradiating with ultraviolet rays (light) are used as the inks. Therefore, UV irradiation devices 61, 62 are provided in the process unit 3 to cure the inks and fix the inks to the sheet S. The inks are cured in the two steps of temporary curing and main curing. UV irradiation devices 61 for temporary curing are provided between the plurality of recording heads 51. Namely, the UV irradiation devices 61 radiate ultraviolet light having a weak irradiance and cures (temporary curing) the ink so that the curing becomes sufficiently slower compared to the ink spreading by wetting method that does not use ultraviolet light, and do not completely cure the inks. The UV irradiation device 62 for main curing is provided on the downstream side in the transfer direction Df with respect to the plurality of recording heads 51. That is, the UV irradiation device 62 radiates stronger irradiance ultraviolet light than the irradiation device 61 to cure (completely cure) so that the wetting spread of the ink stops.

By doing this, the irradiation devices 61 placed between the plurality of recording heads 51 temporarily harden the colored inks ejected onto the sheet S from the recording heads on the upstream side in the transfer direction Df. Consequently, the inks ejected by one of the recording heads 51 onto the sheet S temporarily harden until reaching the recording head 51 adjacent to the recording head 51 on the downstream side in the transfer direction Df. By doing this, the generation of mixed colors of the colored inks having different colors mixed together is suppressed. In this state that suppresses mixed colors, the plurality of recording heads 51 eject mutually different colored inks to form a color image on the sheet S. Furthermore, the UV irradiation device 62 for main curing is provided further on the downstream side in the transfer direction Df than the plurality of recording heads 51. Therefore, the color image formed by the plurality of recording heads 51 is completely cured by the UV irradiation device 62 to fix to the sheet S.

Furthermore, a recording head 52 is provided on the downstream side in the transfer direction Df with respect to the UV irradiation device 62. This recording head 52 faces the front surface of the sheet S wound on the rotating drum 30 with a small clearance space and ejects transparent UV ink from the nozzle onto the front surface of the sheet S by an ink ejection method. Moreover, transparent ink is ejected toward the color image formed by the four color recording heads 51. This transparent ink is ejected onto the entire surface of the color image, and the feel of a glossy feel or a matte feel is given to the color image. In addition, a UV irradiation device 63 is provided on the downstream side in the transfer direction Df with respect to the recording head 52. By irradiating with strong ultraviolet light, the UV irradiation device 63 completely cures the transparent ink ejected by the recording head 52. By doing this, the transparent ink can be fixed to the front surface of the sheet S.

Thus, in the process unit 3, the inks are appropriately ejected and cured for the sheet S wound on the outer periphery of the rotating drum 30 to form the color image coated with the transparent ink. Then, the sheet S formed with the color image transfers to the take-up unit 4 by the back drive roller 32.

In addition to the take-up shaft 40 wound with the end of the sheet S, the take-up unit 4 has a driven roller 41 that winds the sheet S from the back surface side between the take-up shaft 40 and the back drive roller 32. The take-up shaft 40 winds and supports the end of the sheet S when the front surface of the sheet S faces the outside. Namely, when the take-up shaft 40 rotates in the direction of rotation Cf (clockwise direction in FIG. 1), the sheet S transferred from the back drive roller 32 is wound via the driven roller 41 onto the take-up shaft 40. The sheet S is wound onto the take-up shaft 40 via a core tube 42 that can be attached to and removed from the take-up shaft 40. Consequently, when the sheet S wound on the take-up shaft 40 becomes full, the sheet S together with the core tube 42 can be removed.

Figure 2:
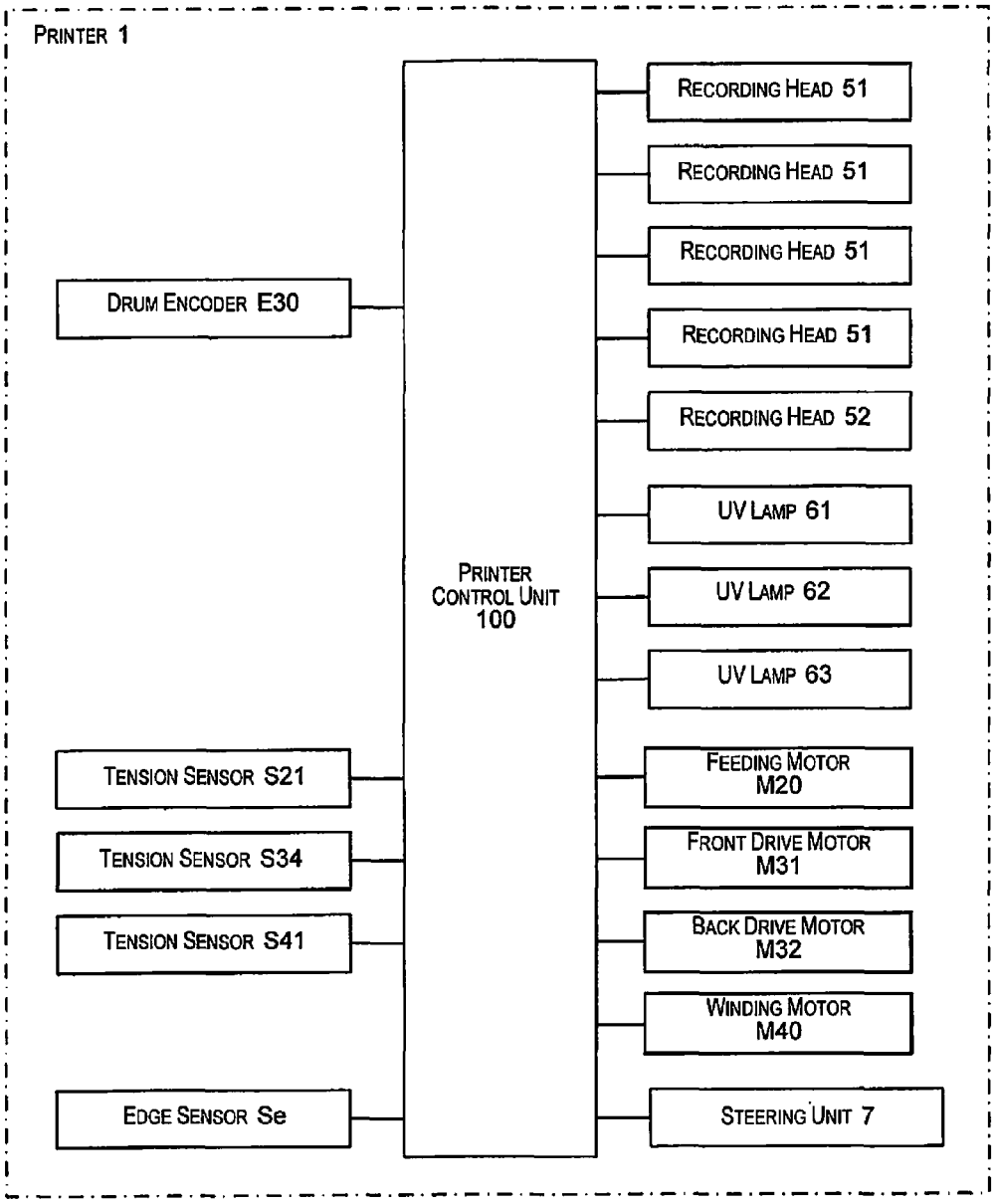
FIG. 2 is a block diagram that shows an example of the electrical configuration for controlling the printer shown in FIG. 1.

The above summarized the configuration of the apparatus of the printer 1. Next, the electrical configuration for controlling the printer 1 is described. FIG. 2 is a block diagram that schematically shows an example of the electrical configuration for controlling the printer shown in FIG. 1. A printer control unit 100 for controlling each unit of the printer 1 is provided in the printer 1. The recording heads, the UV devices, and each device in the sheet transfer system are controlled by the printer control unit 100. Next, control of the printer control unit 100 for each unit in these devices is described in detail.

The printer control unit 100 controls the ink ejection timing of the recording heads 51 for forming the color image in response to the transfer of the sheet S. Specifically, this control of the ink ejection timing is executed based on the output (detected value) of a drum encoder E30 that is attached to the rotating shaft of the rotating drum 30 to detect the rotation position of the rotating drum 30. That is, because the rotating drum 30 has following rotation that accompanies the transfer of the sheet S, the rotating drum can determine the transfer position of the sheet S if the output of the drum encoder E30 that detects the rotation position of the rotating drum 30 is referenced. Therefore, the printer control unit 100 generates the print timing signal (pts) from the output of the drum encoder E30 and controls the ink ejection timing of each of the recording heads 51 based on the pts signal to impact the inks ejected by the recording heads 51 at the target positions on the sheet S being transferred to form a color image.

In addition, the timing at which the recording head 52 ejects the transparent ink is similarly controlled by the printer control unit 100 based on the output of the drum encoder E30. Thus, the transparent ink can be accurately ejected for the color image formed by the plurality of recording heads 51. Furthermore, the timing and amount of irradiated light by turning on and off the lights of the irradiation devices 61, 62, 63 are controlled by the printer control unit 100.

In addition, the printer control unit 100 has a function for controlling the transfer of the sheet S described in detail with reference to FIG. 1. Namely, of the parts configuring the sheet transfer system, motors are connected to each of the feeding shaft 20, the front drive roller 31, the back drive roller 32, and the take-up shaft 40. The printer control unit 100 controls the speed and torque of each motor and controls the transfer of the sheet S while the motors rotate. Transfer control of this sheet S is described next in detail.

The printer control unit 100 rotates feeding motor M20 to drive the feeding shaft 20 to supply the sheet S from the feeding shaft 20 to the front drive roller 31. In this case, the printer control unit 100 controls the torque of the feeding motor M20 and adjusts the tension (feeding tension Ta) of the sheet S from the feeding shaft 20 to the front drive roller 31. A tension sensor S21 that detects the magnitude of the feeding tension Ta is installed in the driven roller 21 that is positioned between the feeding shaft 20 and the front drive roller 31. For example, the tension sensor S21 can be configured from a load cell for detecting the magnitude of the force received from the sheet S. Then, the printer control unit 100 conducts feedback control of the torque of the feeding motor M20 and adjusts the feeding tension Ta of the sheet S based on the detected results (detected values) of the tension sensor S21.

When the sheet S is supplied from the feeding shaft 20 to the front drive roller 31, the printer control unit 100 feeds the sheet S while the position in the width direction (perpendicular direction to the paper plane in FIG. 1) of the sheet S is adjusted. The steering unit 7 that displaces the feeding shaft 20 and the driven roller 21 is provided in the printer in the shaft direction (in other words, width direction of the sheet S). Based on the detection results of the edge sensor Se, the printer control unit 100 conducts feedback control of the steering unit 7 and adjusts the position in the width direction of the sheet S. By doing this, the position in the width direction of the sheet S is optimized, and poor transfers such as meandering of the sheet S are suppressed.

In addition, the printer control unit 100 rotates the front drive motor M31 that drives the front drive roller 31 and the back drive motor M32 that drives the back drive roller 32. By doing this, the sheet S fed from the feeding unit 2 passes through the process unit 3. In this case, velocity control is executed for the front drive motor M31; and torque control is executed for the back drive motor M32. That is, the printer control unit 100 adjusts the rotation speed of the front drive motor M31 to be constant based on the encoder output of the front drive motor M31. Thus, the sheet S is transferred at a constant velocity by the front drive roller 31.

In addition, the printer control unit 100 controls the torque of the back drive motor M32 and adjusts the tension (process tension Tb) of the sheet S from the front drive roller 31 to the back drive roller 32. A tension sensor S34 that detects the magnitude of the process tension Tb is attached to the driven roller 34 arranged between the rotating drum 30 and the back drive roller 32. For example, this tension sensor S34 can be configured from a load cell that detects the magnitude of the force received from the sheet S. The printer control unit 100 performs feedback control of the torque of back drive motor M32 and adjusts the process tension Tb of the sheet S based on the detection results (detected values) of the tension sensor S34.

In addition, the printer control unit 100 rotates the take-up motor M40 that drives the take-up shaft 40 to wind the sheet S transferred by the back drive roller 32 onto the take-up shaft 40. In this case, the printer control unit 100 controls the torque of the take-up motor M40 and adjusts the tension (winding tension Tc) of the sheet S from the back drive roller 32 to the take-up shaft 40. A tension sensor S41 that detects the magnitude of the winding tension Tc is attached to the driven roller 41 arranged between the back drive roller 32 and the take-up shaft 40. For example, this tension sensor S41 can be configured from a load cell that detects the magnitude of the force received from the sheet S. Then the printer control unit 100 performs feedback control of the torque of the take-up motor M40 and adjusts the winding tension Tc of the sheet S based on the detection results (detected values) of the tension sensor S41.

Figure 3:
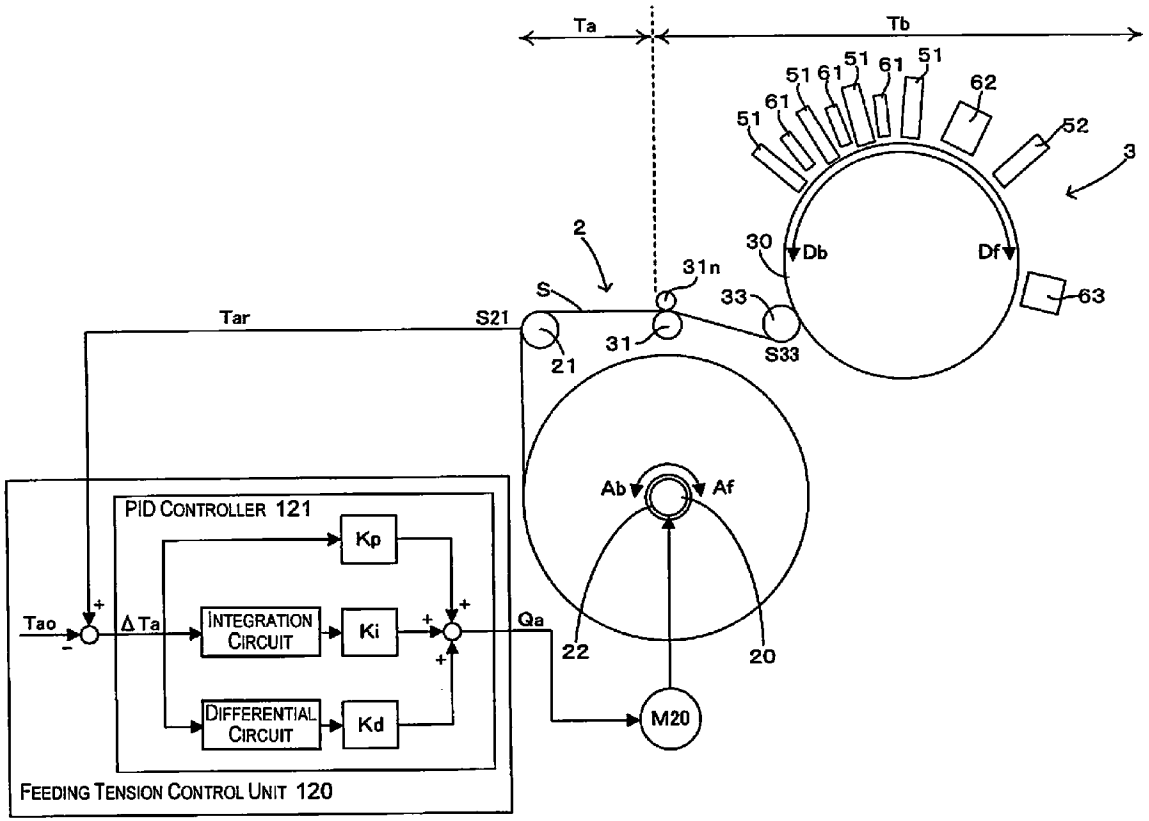
FIG. 3 is a diagram showing an example of a configuration that executes tension control of the sheet.
Figure 4:
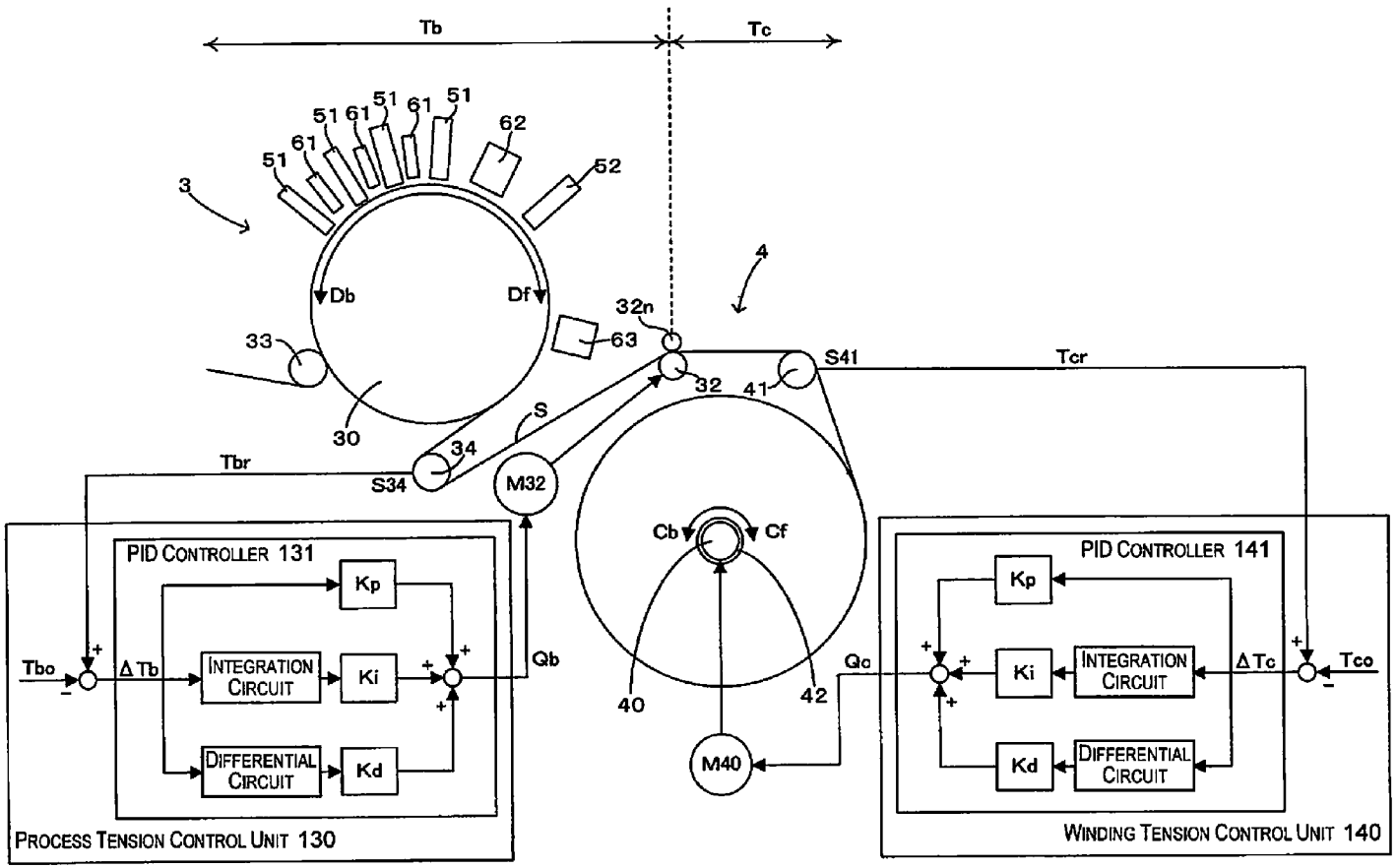
FIG. 4 is a diagram showing an example of a configuration that executes tension control of the sheet.

The above summarized the electrical configuration provided by the printer 1. Next, the electrical configuration is explained in further detail for tension control executed when the sheet S is transferred. FIG. 3 schematically shows the configuration for executing tension control of the sheet for the feeding unit. FIG. 4 schematically shows the configuration for executing tension control of the sheet for the process unit and the take-up unit. As shown in FIG. 3 and FIG. 4, a feeding tension control unit 120 is provided for tension control to the feeding unit 2; a process tension control unit 130 is provided for tension control to the process unit 3; and a winding tension control unit 140 is provided for tension control to the take-up unit 4. These tension control units 120, 130, 140 are installed inside the printer control unit 100 (FIG. 2).

The feeding tension control unit 120 determines the difference ΔTa between the value of the feeding tension Ta (detected value Tar) detected by the tension sensor S21 and the target value Tao of the feeding tension Ta. A proportional integral differential (PID) controller 121 of the feeding tension control unit 120 executes PID control based on this difference ΔTa. That is, the PID controller 121 adds the value of the proportional gain Kp multiplied by the difference ΔTa, the value of the difference ΔTa integrated over time by an integration circuit and multiplied by the integration gain Ki, and the value of the difference ΔTa differentiated with respect to time and multiplied by the differential gain Kd to generate the motor control signal Qa (torque command signal). The feeding motor M20 applies torque corresponding to the motor control signal Qa to the feeding shaft 20 and adjusts the feeding tension Ta. Thus, the feeding tension control unit 120 feeds back the detected value Tar of the feeding tension Ta to the torque of the feeding shaft 20 to control the feeding tension Ta. Thus, feedback control is operated to match the detected value Tar of the feeding tension Ta to the target value Tao to apply a feeding tension Ta equal to the target value Tao to the sheet S.

The process tension control unit 130 determines the difference ΔTb (=Tbr−Tbo) between the value of process tension Tb (detected value Tbr) that was detected by the tension sensor S34 and the target value Tbo of the process tension Tb. In addition, the PID controller 131 of the process tension control unit 130 executes PID control based on this difference ΔTb to generate the motor control signal Qb (torque command signal). Then the back drive motor M32 applies torque corresponding to the motor control signal Qb to the back drive roller 32 and adjusts the process tension Tb. Thus, the process tension control unit 130 feeds back the detected value of the process tension Tb to the torque of the back drive roller 32 and controls the process tension Tb. Thus, feedback control operates to match the detected value Tbr of the process tension Tb to the target value Tbo, and applies the process tension Tb equal to the target value Tbo to the sheet S.

The winding tension control 140 determines the difference ΔTc between the value of the winding tension Tc (detected value Tcr) that was detected by the tension sensor S41 and the target value Tco of the winding tension Tc. In addition, the PID controller 141 of the winding tension control unit 140 executes PID control based on the difference ΔTc to generate the motor control signal Qc (torque command signal). Then, the take-up motor M40 applies torque corresponding to the motor control signal Qc to the take-up shaft 40 and adjusts the winding tension Tc. By doing this, the winding tension control unit 140 feeds back the detected value of the winding tension Tc to the torque of the take-up shaft 40 to control the winding tension Tc. Thus, feedback control operates to match the detected value Tcr of the winding tension Tc to the target value Tco to apply a winding tension Tc equal to the target value Tco to the sheet S.

Thus, the printer control unit 100 controls the tension of the sheet S being transferred. Therefore, the above described the case in which the sheet S was transferred in the transfer direction Df from the feeding shaft 20 to the take-up shaft 40. However, the printer 1 can transfer the sheet S in the direction opposite to the transfer direction Df, namely transfer direction Db from the take-up shaft 40 to the feeding shaft 20. The opposite transfer can be executed with various objectives as proposed in Japanese Laid-Open Patent Publication No. 2013-129062. For example, when image recording that was suspended is restarted, the sheet S is appropriately returned to the feeding shaft 20 side, and is executed to form a new image to be adjacent to the image already formed on the sheet S.

The tensions Ta, Tb, Tc of the sheet S can be similarly controlled by feedback control shown in FIG. 3 and FIG. 4 for the sheet S transferred in the transfer direction Db. However, in this embodiment, when a forward transfer is executed to transfer the sheet S in transfer direction Df, and when a backward transfer is executed to transfer the sheet S in transfer direction Db, the target values Tao, Tac of the tensions Ta, Tc, respectively, are changed. This description refers to FIG. 5 and FIG. 6.

Figures 5, 6:
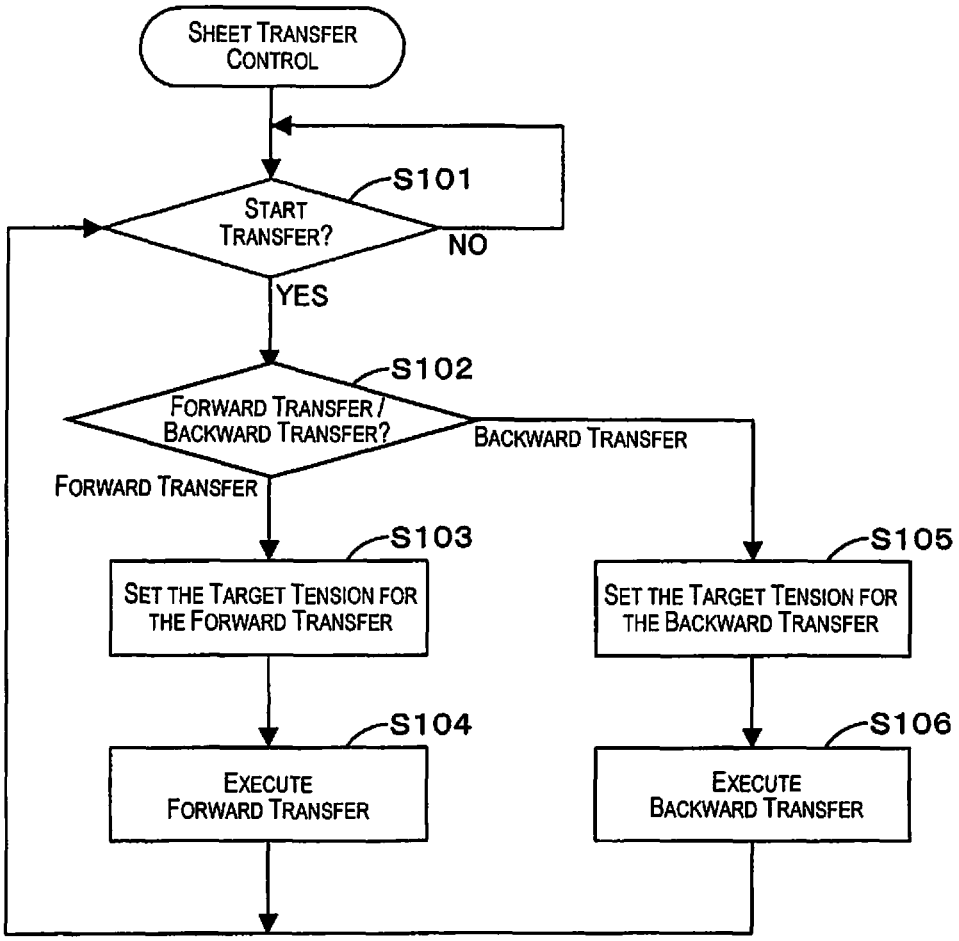
FIG. 5 is a flow chart showing an example of sheet transfer control.
FIG. 6 is a table showing target tension values.

FIG. 5 is a flow chart that shows the sheet transfer control executed by the printer in FIG. 1. FIG. 6 is a table of example target values of the tension for a forward transfer and a backward transfer. Below, transfer direction Df is appropriately named the forward transfer Df, and transfer direction Db is appropriately named the backward transfer direction Db. In step S101, the printer control unit 100 determines whether the sheet S needs to be transferred. When the transfer of the sheet S is not started (when "NO" in step S101), the printer control unit 100 keeps the sheet S stopped. When the sheet S is stopped, tension control on the sheet S is executed as described above. When the transfer of the sheet S starts (when "YES" in step S101), the process advances to step S102. In step S102, the printer control unit 100 determines whether the transfer of the sheet S being executed is a forward transfer or a backward transfer.

When the decision is that a forward transfer is executed in step S102, the process continues to step S103. In step S103, the printer control unit 100 sets the target values Tao, Tbo, Tco, respectively, as the target values of the tensions Ta, Tb, Tc during a forward transfer. Specifically, as shown in FIG. 6, the target value Tao of the tension Ta is set to 60 (N); the target value Tbo of the tension Tb is set to 120 (N); and the target value Tco of the tension Tc is set to 30 (N). The target values Tbo, Tao, Tco in order of magnitude of the tensions Tb, Ta, Tc are set (Tbo>Tao>Tco). When these settings are finished, the process advances to step S104.

In step S104, the printer control unit 100 executes a forward transfer. Specifically, the feedback control described above is executed for the feeding motor M20, the back drive motor M32, and the take-up motor M40 while the front drive roller 31 continues to rotate at a constant velocity in the clockwise direction in FIG. 3. By doing this, while rotating in the rotation direction Af to feed the sheet S in the forward transfer direction Df, the feeding shaft 20 adjusts the tension Ta of the sheet S to the target value Tao (=60 (N)). While rotating in the clockwise direction in FIG. 4 to drive the sheet S in the forward transfer direction Df, the back drive roller 32 adjusts the tension Tb of the sheet S to the target value Tbo (=120 (N)). In addition, while rotating in the rotation direction Cf to wind the sheet S, the take-up shaft 40 adjusts the tension Tc of the sheet S to the target value Tco (=30 (N)). When this tension control is conducted, the sheet S is transferred (forward transfer) in the forward transfer direction Df from the feeding shaft 20 to the take-up shaft 40. Then, when the forward transfer for the specified distance is completed, the process returns to step S101.

On the other hand, when the decision in step S102 determines that a backward transfer is being executed, the process advances to step S105. In step S105, the printer control unit 100 sets the target values Tao, Tbo, Tco of the tensions Ta, Tb, Tc, respectively, as the target values during a backward transfer. Specifically, as shown in FIG. 6, the target value Tao of tension Ta is set to 30 (N); the target value Tbo of tension Tb is set to 120 (N); and the target value Tco of tension Tc is set to 60 (N). Thus, the target values Tbo, Tco, Tao in order of magnitude of tensions Tb, Tc, Ta are set (Tbo>Tco>Tao). When these settings are completed, the process advances to step S106.

In step S106, the printer control unit 100 executes the backward transfer. Specifically, while the front drive roller 31 continues to rotate at a constant velocity in the counterclockwise direction in FIG. 3, the feedback control described above is executed for the feeding motor M20, the back drive motor M32, and the take-up motor M40. Thus, while rotating in the rotation direction Cb (direction opposite to rotation direction Cf) to feed the sheet S in the backward transfer direction Db, the take-up shaft 40 adjusts the tension Tc of the sheet S to the target value Tco (=60 (N)). While rotating counterclockwise in FIG. 4, the back drive roller 32 adjusts the tension Tb of the sheet S to the target value Tbo (=120 (N)). In addition, while rotating in the rotation direction Ab (direction opposite to the rotation direction Af) to wind the sheet S, the feeding shaft 20 adjusts the tension Ta of the sheet S to the target value Tao (=30 (N)). When this tension control is executed, the sheet S is transferred in the backward transfer direction from the take-up shaft 40 to the feeding shaft 20 (backward transfer). Then, when the backward transfer of the specified distance is completed, the process returns to step S101.

As described above, in the printer 1 of this embodiment, the sheet S is transferred in a so-called roll-to-roll transfer by the feeding shaft 20 and the take-up shaft 40 that support different ends of the sheet S. In particular, it is possible to execute a forward transfer in which the sheet S is transferred from the feeding shaft 20 to the take-up shaft 40 and a backward transfer in which the sheet S is transferred from the take-up shaft 40 to the feeding shaft 20. Consequently, the feeding shaft 20 feeds the sheet S when a forward transfer is executed and winds up the sheet S when a backward transfer is executed. In addition, the take-up shaft 40 winds the sheet S when a forward transfer is executed, and feeds the sheet S when a backward transfer is executed.

Tension control is executed so that the tension Ta (=30 (N)) that is applied by the feeding shaft 20 to the sheet S during a backward transfer becomes smaller than the tension Ta (=60 (N)) that is applied by the feeding shaft 20 to the sheet S during a forward transfer. Consequently, when the sheet S is fed (during a forward transfer), the sheet S can be stably fed because the relatively larger tension Ta is applied to the sheet S from the feeding shaft 20. When the sheet S is wound (during a backward transfer), the sheet S can be prevented from being wound onto the feeding shaft 20 at a high tension Ta because the tension Ta applied to the sheet S from the feeding shaft 20 is kept relatively small. As a result, although an image having a relatively thick film formed on the sheet S by curing the UV inks is wound onto the feeding shaft 20, it becomes possible to suppress the development of unevenness in the sheet S due to the thickness of the image.

In addition, tension control is executed so that the tension Tc (=30 (N)) that is applied by the take-up shaft 40 to the sheet S during a forward transfer becomes smaller than the tension Tc (=60 (N)) that is applied by the take-up shaft 40 to the sheet S during a backward transfer. Consequently, when the sheet S is fed (during a backward transfer), the sheet S can be stably fed because the relatively larger tension Tc is applied to the sheet S from the take-up shaft 40. On the other hand, when the sheet S is wound (during a forward transfer), the sheet S can be prevented from being wound onto the take-up shaft 40 at a high tension Tc because the tension Tc applied to the sheet S from the take-up shaft 40 is kept relatively small. As a result, although an image having a relatively thick film formed on the sheet S by curing the UV inks is wound onto the take-up shaft 40, it is possible to suppress the development of unevenness in the sheet S due to the thickness of the image.

In a configuration in which the recording heads 51, 52 face the sheet S as in the printer 1 described above, when the sheet S shifts around during transfer by a forward transfer or a backward transfer, the recording heads 51, 52 and the sheet S are assumed to sometimes come into contact. In contrast, in this embodiment, the front drive roller 31 and the back drive roller 32 are provided; and the recording heads 51, 52 face the sheet S between the drive rollers 31, 32. Then, by controlling the torque in the back drive roller 32, the tension Tb of the sheet S in the part facing the recording heads 51, 52 is controlled. In particular, when either a forward transfer or a backward transfer is executed, the tension Tb is larger than the other tensions Ta, Tc. That is, when either of a forward transfer or a backward transfer is executed, shifting of the sheet S can be suppressed, and contact between the recording heads 51, 52 and the sheet S during transfer can be suppressed because a high tension Tb is applied to the sheet S in the part facing the recording heads 51, 52.

In addition, in the printer 1, UV inks are ejected onto the sheet S being transferred by the forward transfer to form the image. In particular, because of the steering unit 7 that drives the feeding shaft 20 in the shaft direction, the sheet S can be fed to the recording heads 51, 52 from the feeding shaft 20 while the position of the sheet S is adjusted in the axial direction. Moreover, according to this embodiment, because a relatively high tension Ta is applied to the sheet S from the feeding shaft 20 when the sheet S is fed, the position of the sheet S can be effectively adjusted by the steering unit 7; and the sheet S at a position that was appropriately adjusted can be fed from the feeding shaft 20 to the recording heads 51, 52.

As described above, in the above embodiment, the printer 1 corresponds to an example of the "image recording device" of the present invention; the feeding shaft 20 or the take-up shaft 40 corresponds to an example of the "rotation shaft" of the present invention; the rotation direction Af or the rotation direction Cb corresponds to an example of the "first direction" of the present invention; the rotation direction Ab or the rotation direction Cf corresponds to an example of the "second direction" of the present invention; the recording heads 51, 52 correspond to examples of the "ejection unit" of the present invention; and the UV irradiation devices 61, 62, 63 correspond to examples of the "irradiation unit" of the present invention. In addition, the feeding shaft 20 corresponds to an example of the "first rotation shaft" of the present invention; the take-up shaft 40 corresponds to an example of the "second rotation shaft" of the present invention; the forward transfer corresponds to an example of the "first operation" of the present invention; the backward transfer corresponds to an example of the "second operation" of the present invention; the front drive roller 31 corresponds to an example of the "first drive roller" of the present invention; the back drive roller 32 corresponds to an example of the "second drive roller" of the present invention; the steering unit 7 corresponds to an example of the "steering unit" of the present invention; and tension sensor S21 or tension sensor S41 corresponds to an example of the "measurement unit" of the present invention. In addition, for feeding shaft 20, step S104 corresponds to an example of the "first process" of the present invention; and step S106 corresponds to an example of the "second process" of the present invention. For take-up shaft 40, step S106 corresponds to an example of the "first process" of the present invention; and step S104 corresponds to an example of the "second process" of the present invention.

The present invention is not limited to the above embodiments. Various changes can be added to the above embodiments without deviating from the intent. Therefore, the target values Tao, Tbo, Tco set for each of the forward transfer and the backward transfer may be appropriately changed from the above examples. For example, the target value Tao (=60 (N)) when the feeding shaft 20 rotates in rotation direction Af becomes 2 times the target value Tco (=30 (N)) when the feeding shaft 20 rotates in rotation direction Ab. However, the target value Tao when the feeding shaft 20 rotates in the rotation direction Af may be 2 or more times greater than or less than 2 times the target value Tco when the feeding shaft 20 rotates in rotation direction Ab (although at least 2 times is preferable). In addition, similar modifications are possible for the take-up shaft 40.

Also, in the above embodiments, velocity control is executed for the front drive roller 31, and torque control is executed for the back drive roller 32. However, torque control may be executed for the front drive roller 31, and velocity control may be executed for the back drive roller 32.

In the above embodiment, tapered tension control may be executed to reduce the winding tension Tc in response to an increase in the roll radius of the sheet S supported by the take-up shaft 40.

In addition, the present invention can be applied to a printer 1 that is not provided with either the feeding shaft 20 or the take-up shaft 40.

In addition, the parts that support the sheet S being transferred are not limited to a cylindrical shape such as the rotating drum 30 described above. Consequently, a flat platen that supports the sheet S in a plane can be used.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims.

What is claimed is:

1. An image recording apparatus, comprising:

a rotation shaft configured to rotate in a direction of feeding of a sheet and a direction of winding of the sheet while supporting the sheet;

a control unit configured to apply tension to the sheet by the rotation shaft by controlling torque applied to the rotation shaft;

an ejection unit configured to eject light-curable liquid onto the sheet; and an irradiation unit configured to irradiate the liquid ejected onto the sheet by the ejection unit, the control unit being configured to apply the tension to the sheet such that the tension applied to the sheet while the rotation shaft rotates in the direction of the feeding of the sheet is at least two times greater than the tension applied to the sheet while the rotation shaft rotates in the direction of the winding of the sheet.

2. An image recording apparatus, comprising:

a first rotation shaft supporting one end of a sheet;

a second rotation shaft supporting the other end of the sheet;

a control unit configured to apply tension to the sheet by the first rotation shaft and the second rotation shaft by controlling the first rotation shaft and the second rotation shaft;

an ejection unit configured to eject light-curable liquid onto the sheet; and an irradiation unit configured to irradiate light onto the light-curable liquid on the sheet, the first rotation shaft and the second rotation shaft being configured to rotate in a first direction that is a direction in which the first rotation shaft feeds the sheet and a direction in which the second rotation shaft winds the sheet, and a second direction that is a direction in which the second rotation shaft feeds the sheet and a direction in which the first rotation shaft winds the sheet, the control unit being configured such that the tension applied to the sheet by the first rotation shaft when the first rotation shaft rotates in the second direction is smaller than the tension applied to the sheet by the first rotation shaft when the first rotation shaft rotates in the first direction, and the tension applied to the sheet by the second rotation shaft when the second rotation shaft rotates in the first direction is smaller than the tension applied to the sheet by the second rotation shaft when the second rotation shaft rotates in the second direction.

3. The image recording apparatus according to claim 2, wherein the control unit is configured to execute a first operation in which the first rotation shaft and the second rotation shaft rotate in the first direction, and the sheet is transferred from the first rotation shaft to the second rotation shaft, and a second operation in which the first rotation shaft and the second rotation shaft rotate in the second direction, and the sheet is transferred from the second rotation shaft to the first rotation shaft.

4. The image recording apparatus according to claim 3, wherein the control unit is further configured to set the tension applied to the sheet by the second rotation shaft smaller than the tension applied to the sheet by the first rotation shaft when the first operation is executed, and set the tension applied to the sheet by the first rotation shaft smaller than the tension applied to the sheet by the second rotation shaft when the second operation is executed.

5. The image recording apparatus according to claim 3, further comprising a first drive roller configured to drive the sheet between the first rotation shaft and the second rotation shaft, and a second drive roller configured to drive the sheet between the first drive roller and the second rotation shaft, wherein the ejection unit faces the sheet between the first drive roller and the second drive roller, the control unit is configured to control at least one of the first drive roller and the second drive roller, and control the tension of the sheet between the first drive roller and the second drive roller, such that when either of the first operation and the second operation is executed, the tension applied to the sheet between the first drive roller and the second drive roller is greater than the tension applied to the sheet by the first rotation shaft and the tension applied to the sheet by the second rotation shaft.

6. The image recording apparatus according to claim 5, further comprising a steering unit configured to drive the first rotation shaft in an axial direction, wherein the ejection unit is configured to eject the light-curable liquid onto the sheet being transferred by the first operation.

7. The image recording apparatus according to claim 2, wherein the control unit being configured such that the tension applied to the sheet by the first rotation shaft when the first rotation shaft rotates in the first direction is at least two times the tension applied to the sheet by the first rotation shaft when the first rotation shaft rotates in the second direction.

8. An image recording apparatus, comprising:

a rotation shaft configured to rotate in a first direction and a second direction that is a direction opposite to the first direction;

a first drive roller and a second drive roller configured to drive a sheet;

a control unit configured to apply tension to the sheet by the rotation shaft by controlling torque applied to the rotation shaft;

an ejection unit configured to eject light-curable liquid onto the sheet;

an irradiation unit configured to irradiate light onto the liquid ejected by the ejection unit onto the sheet; and a measurement unit configured to measure the tension of the sheet, in the first direction that is a direction in which the rotation shaft feeds the sheet, the rotation shaft, the first drive roller, the second drive roller, the ejection unit, and the measurement unit being arranged in the order of the rotation shaft, the measurement unit, the first drive roller, the ejection unit, and the second drive roller, the control unit being configured such that measurement values of the measurement unit when the rotation shaft rotates in the second direction being smaller than measurement values of the measurement unit when the rotation shaft rotates in the first direction.

9. A sheet transfer method, comprising:

applying tension to a sheet by a rotation shaft while feeding from the rotation shaft the sheet on which an image is formed by curing light-curable liquid by light irradiation; and applying tension to the sheet by the rotation shaft while winding the sheet onto the rotation shaft, the tension applied to the sheet during the feeding of the sheet being at least two times greater than the tension applied to the sheet during the winding of the sheet.

* * * * *